US007540703B2

(12) United States Patent
Mercure

(10) Patent No.: US 7,540,703 B2
(45) Date of Patent: Jun. 2, 2009

(54) METHOD AND APPARATUS FOR THE FREE-FALL TRANSFER OF PANELS

(75) Inventor: Roger Mercure, Mascouche (CA)

(73) Assignee: Bromer Inc., Terrebonne (CA)

( * ) Notice: Subject to any disclaimer, the term of this patent is extended or adjusted under 35 U.S.C. 154(b) by 139 days.

(21) Appl. No.: 11/418,181

(22) Filed: May 5, 2006

(65) Prior Publication Data

US 2006/0251504 A1 Nov. 9, 2006

Related U.S. Application Data

(60) Provisional application No. 60/678,175, filed on May 6, 2005.

(51) Int. Cl.

| | |
|---|---|
| ***B65H 3/00*** | (2006.01) |
| ***B65G 59/02*** | (2006.01) |
| ***B65H 3/08*** | (2006.01) |
| ***B65H 1/02*** | (2006.01) |

(52) U.S. Cl. ..... 414/796.6; 414/907; 414/796.8; 414/797

(58) Field of Classification Search ..... 198/836.1; 294/119.1, 64.1; 414/798.2, 796.6, 781, 414/770, 768, 783, 907, 796.8; 901/40; 271/10.01, 271/150, 107, 139, 141, 91, 93; 221/292, 221/293; 254/131

See application file for complete search history.

(56) References Cited

U.S. PATENT DOCUMENTS

| | | | | |
|---|---|---|---|---|
| 1,539,083 | A * | 5/1925 | Henderson | 271/91 |
| 1,792,576 | A * | 2/1931 | Dryon | 294/65 |
| 3,701,440 | A * | 10/1972 | Windstrup et al. | 414/795.6 |
| 4,925,361 | A | 5/1990 | Ellis et al. | |
| 4,966,271 | A * | 10/1990 | Jenkner | 198/409 |
| 5,391,050 | A * | 2/1995 | Gatteschi | 414/796 |
| 5,984,623 | A * | 11/1999 | Smith et al. | 414/797 |
| 6,052,193 | A * | 4/2000 | Kim et al. | 356/388 |
| 6,615,565 | B2 * | 9/2003 | Dekker | 53/399 |

* cited by examiner

*Primary Examiner*—Gregory W Adams
(74) *Attorney, Agent, or Firm*—Ogilvy Renault LLP

(57) ABSTRACT

An apparatus and method for transferring panels from a stack of generally upstanding panels to a lying position on a receiving surface. The apparatus comprises a pulling device having a tool end adapted to be releasably connected to a surface of a panel of the stack in a contacting position. The pulling device is actuatable to displace the tool end to the contacting position. An actuator member operatively supports the pulling device so as to displace the pulling device away from the panel, to pull the panel away from the stack by actuation of the actuator member to create a gap between the panel and the stack. A pushing device has a portion adapted to be inserted in the gap in a pushing position. The pushing device is operatively supported by the actuator member, whereby the pushing device in the pushing position pushes the panel away from the stack. A controller unit is connected to the devices and the actuator member, so as to induce the free fall of the panels from the stack with the pulling device away from the free fall path.

14 Claims, 5 Drawing Sheets

METHOD AND APPARATUS FOR THE FREE-FALL TRANSFER OF PANELS

CROSS-REFERENCE TO RELATED APPLICATION

This patent application claims priority on U.S. Provisional Patent Application No. 60/678,175, filed on May 6, 2005 by the present applicant.

FIELD OF THE INVENTION

The present invention relates to a method and apparatus for the transfer of a panel from a stack of slightly inclined panels to a horizontal position.

PRIOR ART

U.S. Pat. No. 4,925,361, issued to Ellis et al. on May 15, 1990, relates to a method for transferring rigid, rectangular, flat sheets of glass from a substantially vertical storage position to a horizontal position. This method includes the steps of: storing a stack of sheets of glass against an inclined surface such that the bottom of each sheet is located forward of the top thereof to cause the plane of the sheets to tilt a few degrees past vertical on one side of a vertical plane through the bottom of the top sheet of the stack; engaging the top sheet of the stack near its top by means of a vacuum member; moving the vacuum member away from the stack of sheets to pull the top of such top sheet forward a predetermined distance to pivot such top sheet about the bottom thereof a predetermined number of degrees past vertical on the other side of said vertical plane; releasing the sheet to permit it to free-fall to a horizontal position, pivoting about the bottom thereof; and catching the sheet on a horizontal surface located in a plane substantially the same as the plane of the bottoms of the sheets in the stack in the storage position.

However, this prior-art device allowing to perform free fall of panels, especially glass panels, shows inconveniences. Indeed, according to prior-art devices and methods, a panel at the top of a stack of panels ought to be grasped by a suction cup at its top edge and pulled beyond the vertical before being released by the suction cup in order to be allowed to fall freely on a horizontal surface. However, because panels may be of different sizes, the height of the suction cup and pulling device must be adjusted vertically in order to grasp the top panel at its top edge.

Moreover, the suction cup must be timely displaced out of the path of free fall of the panel, otherwise contact between the suction cup and the free-falling panel could result in damages to the panel.

Also, because the flexibility of panel is a function of the constitutive material of said panel and function of the thickness and size of said panel, determination of the point at which a panel will free-fall on a horizontal surface (i.e., the point at which the suction cup must release the panel) is difficult to determine.

SUMMARY OF THE INVENTION

Therefore, it is an aim of the present invention to provide a method and an apparatus addressing the issues associated with the methods and apparatuses of the prior art.

Therefore, in accordance with the present invention, there is provided a method for transferring panels from a stack of generally upstanding panels to a lying position on a receiving surface, said method comprising the steps of: separating a first panel from the stack of panels by pulling the first panel away from the stack with a pulling device releasably connected to the first panel in a contacting position, so as to create a gap between the first panel and the stack; inserting a pushing device in the gap between the first panel and the stack; removing the pulling device from the contacting position with the first panel; and inducing the first panel to free fall to the lying position by pushing the first panel with the pushing device to a free-fall position.

Further in accordance with the present invention, there is provided an apparatus for transferring panels from a stack of generally upstanding panels to a lying position on a receiving surface, the apparatus comprising: a pulling device having a tool end adapted to be releasably connected to a surface of a panel of the stack in a contacting position, the pulling device being actuatable to displace the tool end between the contacting position, and an offset position in which the pulling device is away from a free-fall path of the panels of the stack; at least one actuator member operatively supporting the pulling device so as to displace the pulling device away from the panel, whereby the pulling device in the contacting position pulls the panel away from the stack by actuation of the second extendable member to create a gap between the panel and the stack; a pushing device having a portion adapted to be inserted in said gap in a pushing position, the pulling device actuatable to displace said portion of the pushing device to the pushing position, the pushing device being operatively supported by said at least one actuator member, whereby the pushing device in the pushing position pushes the panel away from the stack by actuation of said at least one actuator member to induce the free fall of the panel to the lying position; and a controller unit connected to the pulling device, the at least one actuator member and the pushing device, so as to induce the free fall of the panels from the stack with the pulling device away from the free fall path.

BRIEF DESCRIPTION OF DRAWINGS

The present invention will; be better understood with reference to the enclosed drawings showing embodiments thereof.

DETAILED DESCRIPTION OF A PREFERRED EMBODIMENT

Figure 1:
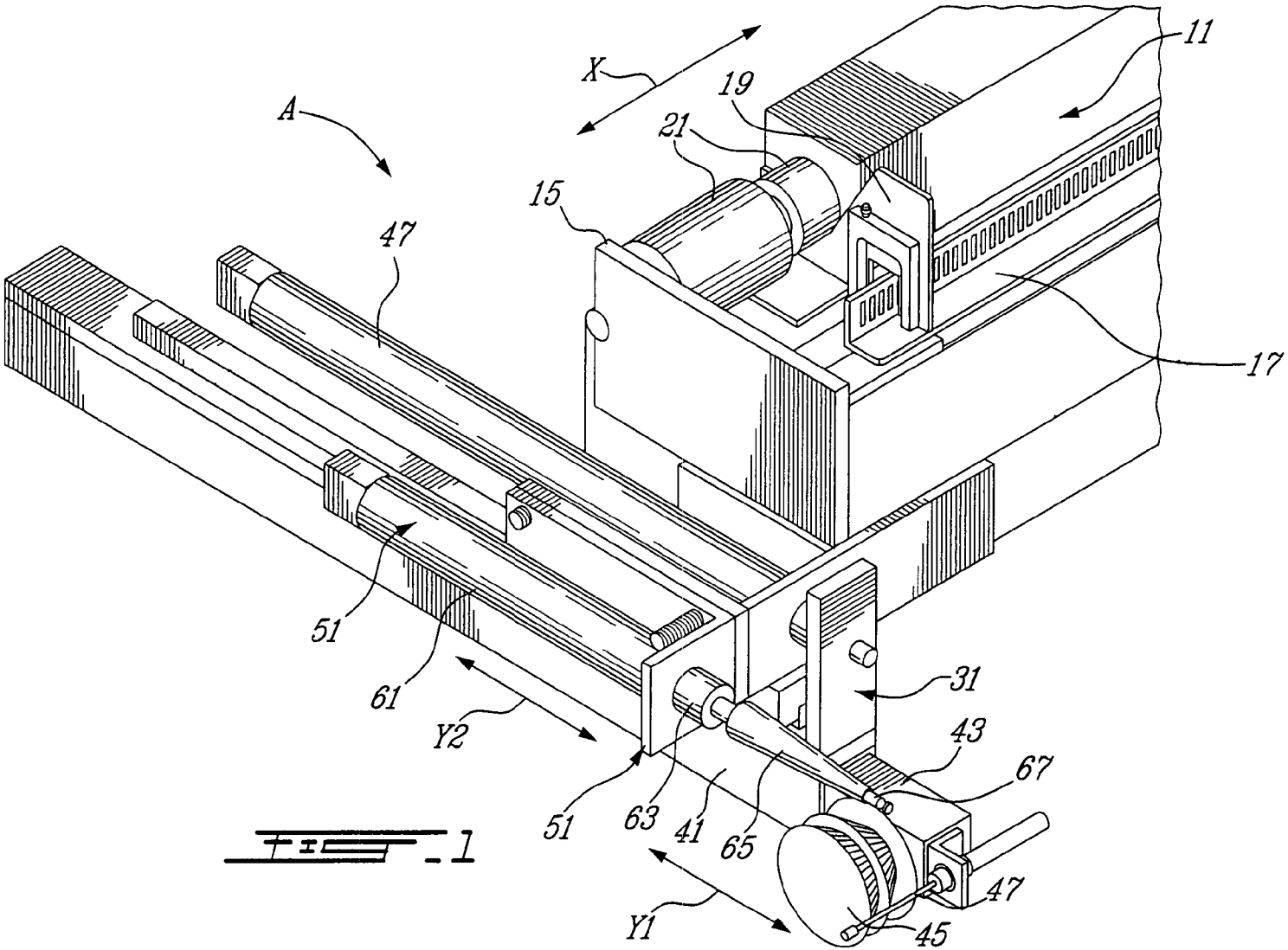
FIG. 1 is a perspective view of an apparatus for inducing the free-fall transfer of a panel, constructed in accordance with a preferred embodiment of the present invention.
Figure 2:
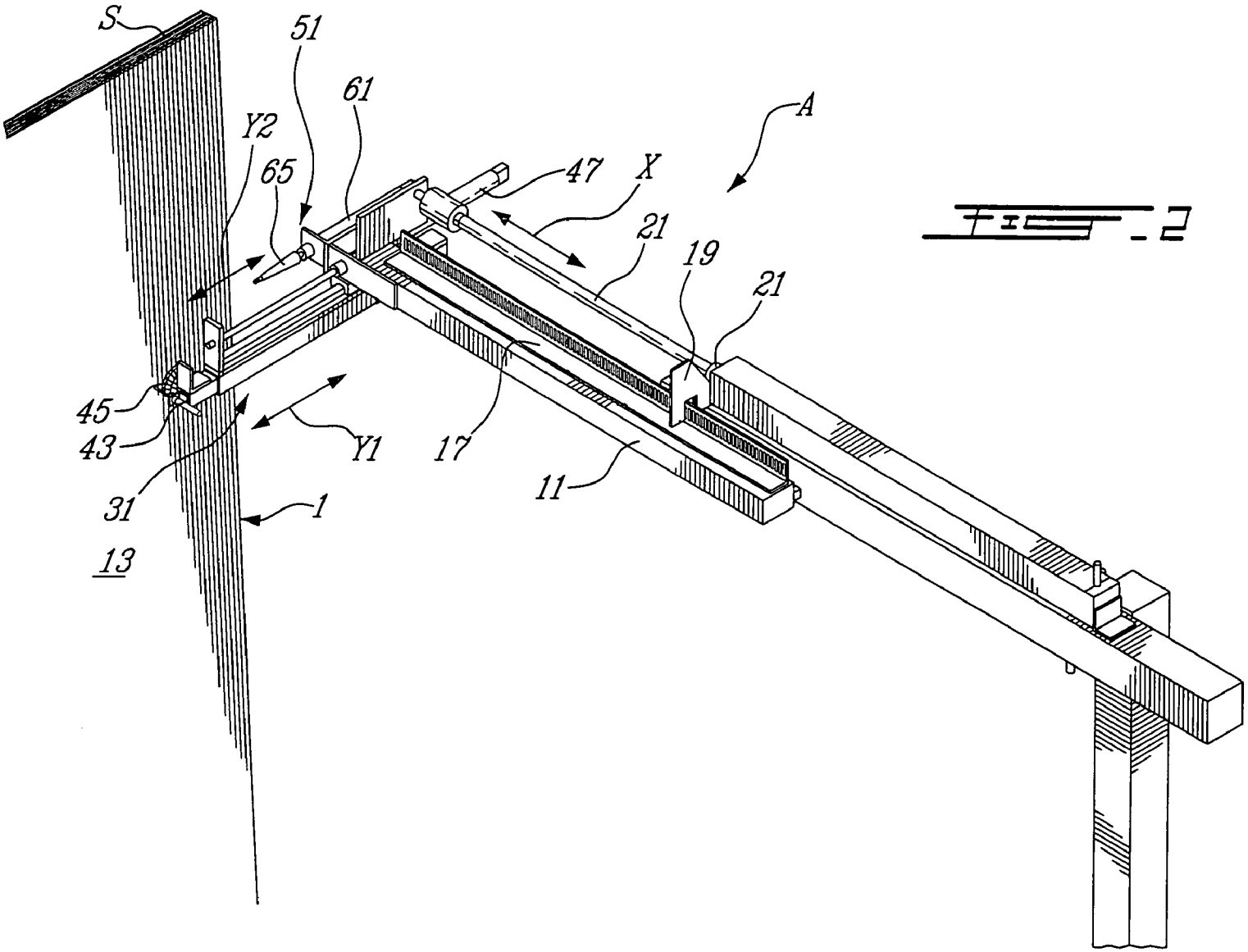
FIG. 2 is a perspective view of the apparatus of FIG. 1, with a pulling device contacting a panel.

Referring to the drawings, and more particularly to FIGS. 1 and 2, an apparatus for the transfer of a panel 1 from a stack S of slightly inclined panels 1 (i.e., a stack of upstanding panels) is generally illustrated at A. The apparatus A has a first extendable elongated member 11 that is substantially horizontal, and has a support end 15 that is displaceable along direction X. As seen in FIG. 2, direction X is near-normal to a plane of the exposed face 13 of the panel 1 at the top of the stack S of panels. The first extendable elongated member 11 is, however, offset with respect to the panel 1. A combination of a slotted bar 17 and sensor 19 is provided along the elongated member 11 for the measurement of displacement of the support end 15, as will be described hereinafter.

A degree of actuation, such as a pneumatic jack 21, allows movement of the support end 15 of the first extendable member 11 along direction X. Alternatively, pneumatic jack 21 may be replaced by an electric linear actuator, a mechanical device and/or hydraulic jack. The bar 17 is displaceable along direction X with the support end 15 while the sensor 19 is fixed to the jack 21.

Referring to FIG. 1, a pulling device 31 is mounted to the support end 15 of the first extendable elongated member 11. The pulling device 31 is provided to contact and grasp a portion of the face 13 of the panel 1. As the support end 15 is offset with respect to the panel 1, the pulling device 31 is displaceable along direction Y1, which direction is generally parallel to a plane of the face 13 of the panel 1, by way of a second extendable elongated member 41 to subsequently engage contact with the panel 1.

Figure 4:
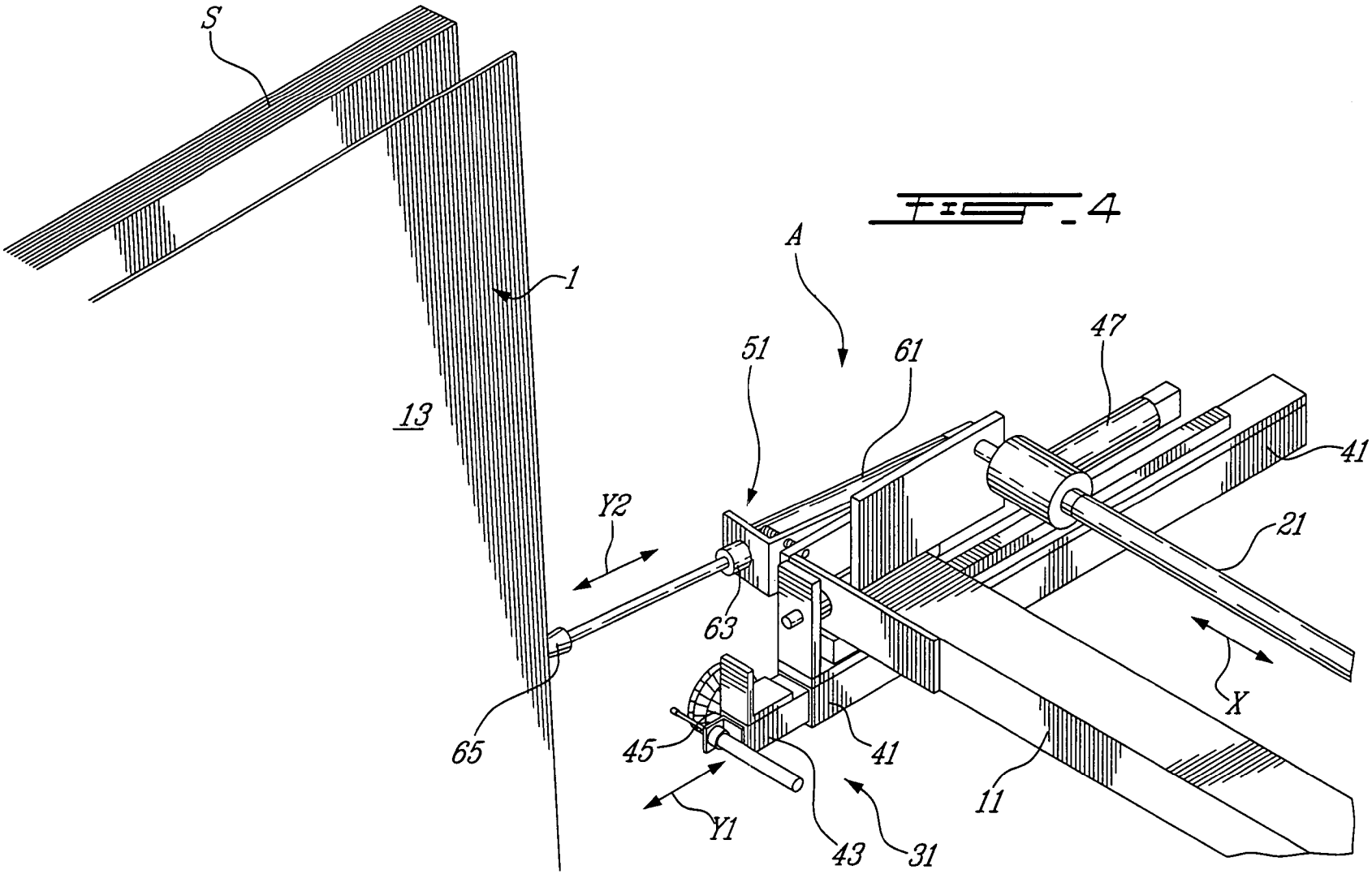
FIG. 4 is a perspective view of the apparatus of FIG. 1, with the pushing device pushing the panel to free fall while the pulling device has been retracted.

More specifically, a support end 43 (i.e., a tool end) of the member 41 has at least one suction cup 45. The suction cup 45 is thus movable between two positions, that is, a first position in which the suction cup 45 is aligned with the surface 13 of the panel 1 at the top of the stack S of panels 1, preferably near a lateral side of said panel 1 as shown in FIG. 2, and a second position (FIG. 4) in which the pulling device is tucked away from a free-fall pathway (hereinafter FFP) of the panel 1. Therefore, once aligned with the panel 1, the suction cup 45 is brought into contact therewith by extension of the elongated member 11 in the direction X. A limit switch 47 is provided to prevent over extension of the member 11, as will be described hereinafter.

The second extendable elongated member 41 is actuated by way of an actuator, such that the suction cup 45 is displaceable between the positions. Preferably, the actuator is pneumatic jack 47. Optionally, the jack 47 may be replaced by an electric linear actuator, a mechanical device or a hydraulic jack.

The suction cup 45 is connected to a vacuum inducer allowing to selectively create/break a pressure differential between the suction cup 45 and the free face 13 of the panel 1 and thereby selectively make the suction cup 45 adhere to the panel 1 or release the panel 1. The vacuum inducer typically has a vacuum pump and a vacuum line in fluid communication with the interior of the suction cup 45.

A pushing device 51 is also mounted to the support end 15 of the first extendable elongated member 11. The pushing device 51 is provided to contact and push a rear portion of the panel 1. The pushing device 51 is displaceable along direction Y2, which direction is parallel or nearly parallel to direction Y1 of the pulling device 31, by way of a third extendable elongated member 61. The orientation of the member 61 with respect to the member 31 is manually adjustable. A support end 63 of the member 61 has at least one pushing member 65.

The pushing member 65 is movable between two positions, that is, a first position allowing the member 65 to engage the face opposite the free face of the panel 1 of the stack S of panels 1 (FIG. 3), and a second position in which the pushing member is retracted so as to avoid any contact of the pushing member 65 with the panel 1 of the stack S, as shown in FIG. 2. The pushing member 65 preferably has a frusto-conical shape to contact a lateral edge of the panel 1 to generally prevent any possible damage to the panel. A limit switch 67 is typically provided at the tip of the pushing member 65, to avoid direct contact between the pushing member 65 and the lateral side of the panel 1. This will be described in further detail hereinafter.

The actuation along direction Y2 is performed by an actuator. Preferably, a pneumatic jack is used. In the illustrated embodiment, the support end 63 and the pneumatic jack define the extendable elongated member 61. Optionally, the jack may be replaced by a linear actuator, a mechanical device or a hydraulic jack.

Figure 5:
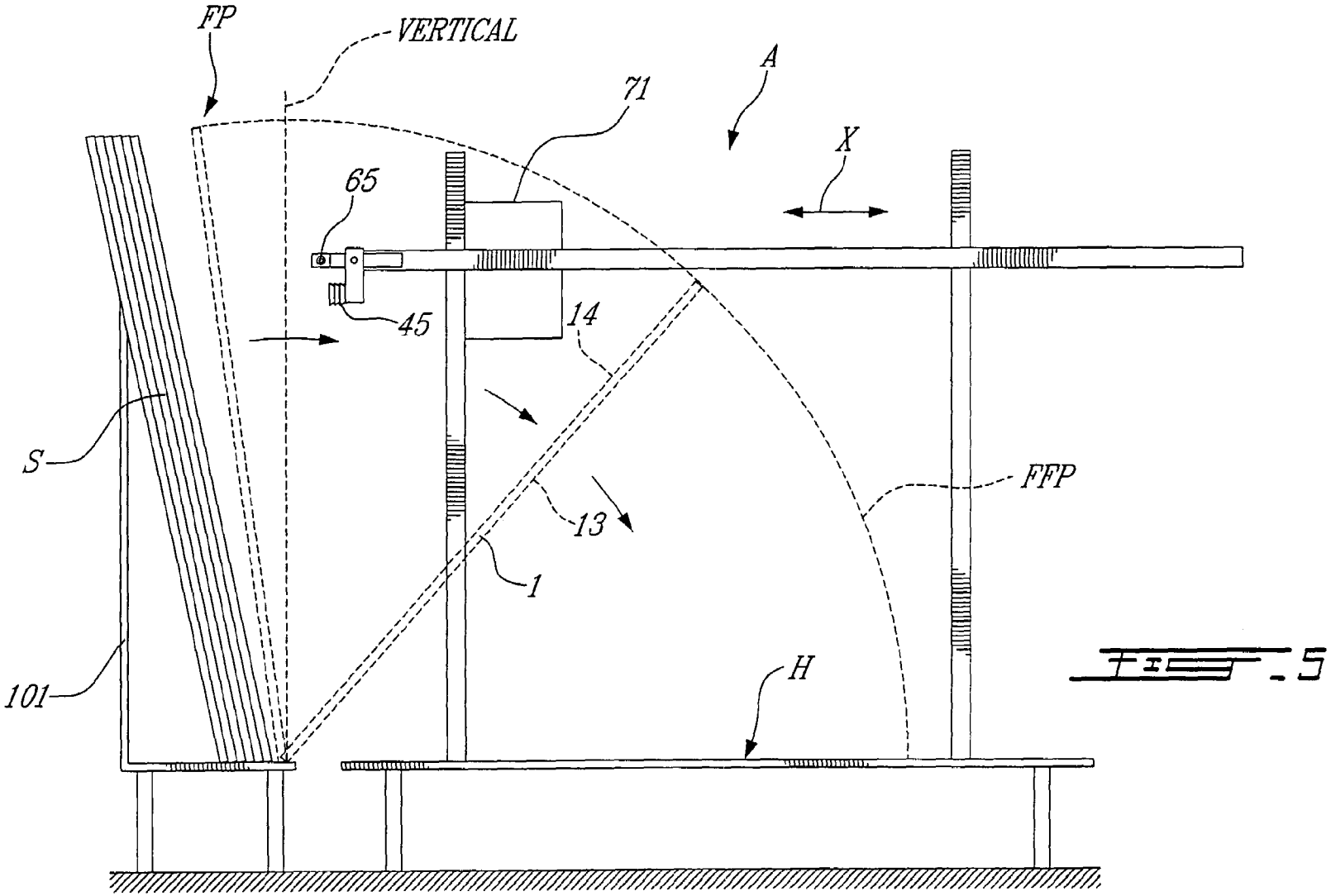
FIG. 5 is a schematic side view showing the apparatus of FIG. 1, with a panel in free-fall.

As seen in FIG. 5, a controller unit 71 is provided in association with the various actuatable components of the apparatus A to control a method of operation thereof following a predetermined sequence. The controller unit 71 allows the first extendable elongated member 11 to be moved independently along direction X between an engagement position and a remote position, and the second extendable elongated member 41 and the third extendable elongated member 61 to be moved independently along their respective directions Y1 and Y2. The controller unit 71 (see FIG. 5) therefore allows the pulling device 31 and the pushing device 51 to be reset to their initial position in order to set up the free fall of panel 1 and of subsequent panels from the stack S.

Advantageously, the controller unit 71 is associated with a plurality of sensors and limits switches so as to receive signals therefrom to control, start and stop each movement of the apparatus A, as will be described hereinafter.

Now that various components of the apparatus A have been described, a general description of a method of operation of the apparatus A is provided. As seen in FIG. 5, a stack S of slightly inclined panels rests on a support 101, with a first panel 1 exposed. The support 101 is open in its front to allow each panel of the stack S to pivot about its bottom edge according to a free-fall pathway FFP. Each panel of the stack S is launched individually into free-fall by the apparatus A.

A horizontal receiving surface H (or like surface receiving the panels in a lying position) is positioned adjacent to the support 101 to as to receive the free-fallen panels from the stack S of panels 1. The receiving surface H is typically part of a conveyor that will convey the panels away for treatment, packaging or the like.

The apparatus A is then actuated to bring the pulling device 31 and its suction cup 45 into grasping engagement with a top corner of the foremost panel of the stack S, namely panel 1. It is pointed out that a vertical position of the apparatus A is adjusted prior to the free-falling operations. For instance, as shown in FIG. 5, the apparatus A is aligned vertically along direction Z by a manually operable switch. Alternatively, a position sensor could be provided to adjust the vertical position of the apparatus A in view of the height of the panels. As seen in FIG. 2, the suction cup 45 is moved along direction Y1 so as to be opposite the top corner of the panel 1. The member 11 is then extended along direction X at a controlled pace so as to have the suction cup 45 come into grasping engagement with the top corner of the panel 1.

The panel 1 is then pulled by retraction of the member 11 along direction X to pivot it about its bottom edge and away from the remainder of the stack S toward a first position FP (FIG. 5).

Figure 3:
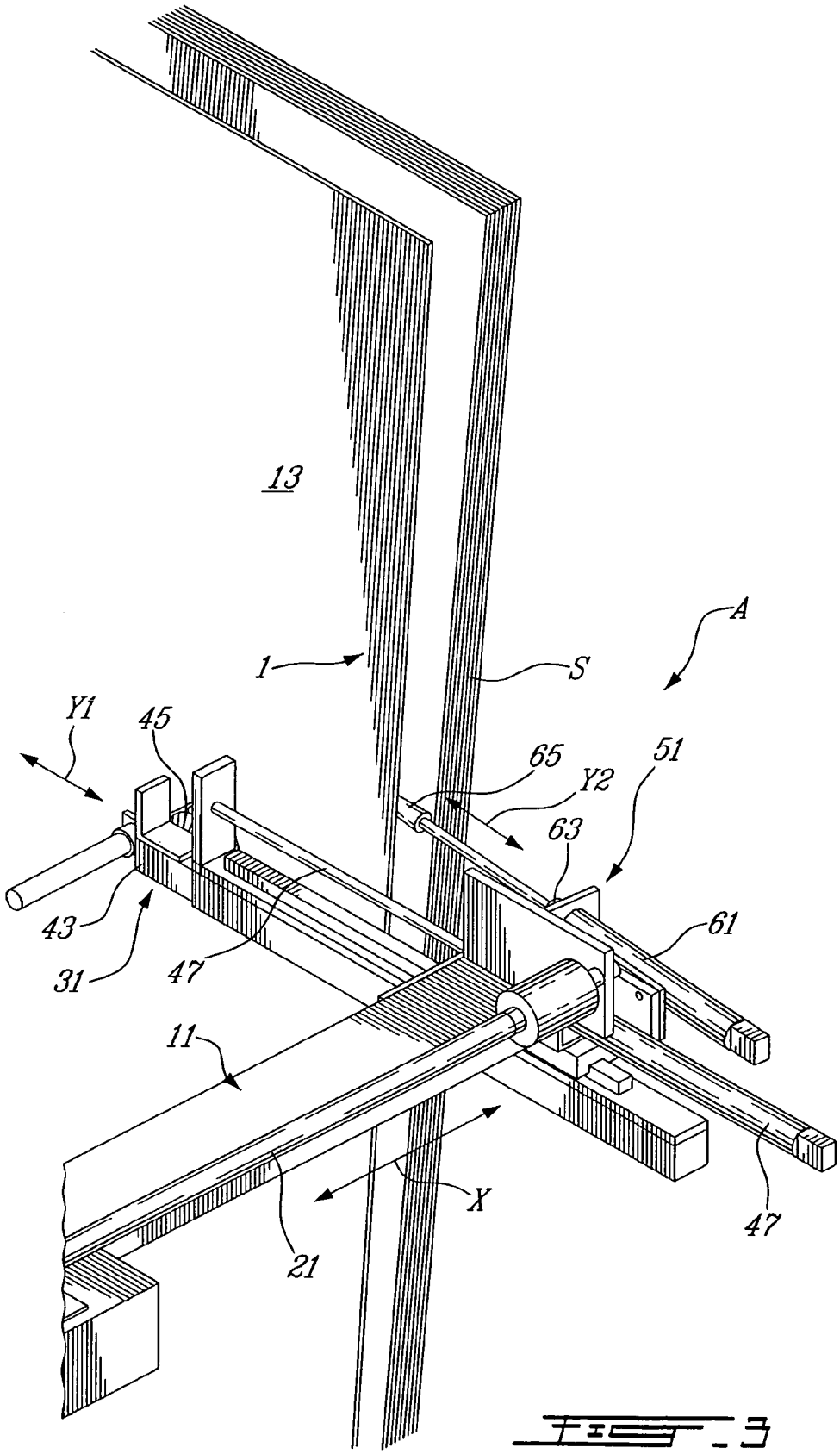
FIG. 3 is a perspective view of the apparatus of FIG. 1, with a pushing device moving into a gap between panels.

As shown in FIG. 3, the pushing device 51 is then actuated so as to bring the pushing member 65 into the gap between the panel 1 and the next panel in the stack S. The suction cup 45 of the pulling device 31 is released from the top corner of the face 13 of the panel 1 as the pushing member 65 takes over at position FP of the panel 1 by pushing the panel 1 to continue to pivot it about its bottom edge. The pulling device 31 (i.e., the suction cups 45) is retracted along the direction Y1, so as not to impede the free fall of the panel 1 along the path FFP (FIG. 5). The panel 1 then loses contact with the pushing member 65 and falls freely along path FFP by pivoting about its bottom edge toward the horizontal receiving surface H.

The fallen panel is then received on the horizontal receiving surface H and is conveyed away.

The pushing device 51 is then retracted along direction Y2 in a resetting of a free-fall cycle for a subsequent panel from the stack S.

In one embodiment, the vertical position of the apparatus A is adjusted as a function of the average height of a plurality of stacked panels having various sizes. Such an alternative prevents having to correct the height systematically for each size of panel.

According to another embodiment, when the suction cup 45 contacts the free face 13 of the panel 1, the resulting pressure differential is detected and a signal is sent to the controller unit 71 to activate the pulling of the panel 1 by actuation of the member 11 away from the stack S and toward the first position FP.

As previously mentioned, the conical shape for the pushing member 65 and the angle of direction Y2 will minimize contact of this latter with the rear of the panel 1.

Considering that the panels to be transferred by free fall are often fragile (e.g., the apparatus A is suitable for use with glass panels), it is preferred to provide the apparatus A with sensors that will ensure that no movement of the apparatus A will cause damage to the panels.

Referring to FIG. 1, the slotted bar 17 and sensor 19 are combined to provide the controller unit 71 (FIG. 5) with reference information relating to the position of the apparatus A along the X direction. More specifically, it is desired to obtain position data associating the suction cup 45 to the stack S of panels.

The slotted bar 17 is therefore provided with numerous slots of a given width, with the sensor 19 being capable of providing a count of slots resulting from a displacement of the bar 17. The displacement of the bar 17 is caused by the extension/retraction of the member 11, as the bar 17 is fixed to the member 11, while the sensor 19 is immovable. Knowing the spacing between the slots of the bar 17, the controller unit 71 (FIG. 5) calculates a distance between the suction cup 45 and the stack S, as well as the distance by which the panel 1 has been pulled of the stack S. These calculations are used by the controller unit 71 to optimize the movements of the apparatus A along the X direction.

Referring to FIG. 1, the limit switch 47 is provided adjacent to the suction cup 45. It has been discussed previously that a pressure sensor associated with the controller unit 71 is typically connected to the suction cup 45 so as to determine when the cup 45 has engaged contact with the panel 1. Once contact is made, the controller unit 71 stops the extension of the member 11 along direction X.

However, to ensure that the extension of the member 11 is stopped, another level of safety is provided with the limit switch 47. The limit switch 47 has an end that will contact the panel 1 during extension of the member 11. The limit switch 47 is set so as to be triggered if the suction cup 45 reaches a suitable contact position against the panel 1 while the extension of the member 11 continues. In an embodiment, activation of the limit switch 45 results in the controller unit 71 producing an alarm signal and stopping operation of the apparatus A.

Referring to FIG. 1, the limit switch 67 is provided at the tip of the pushing member 67. The limit switch 67 is triggered by the pushing member 67 contacting the lateral edge of one of the panels of the stack S. As described previously, it is expected that the pushing member 67 fits in the gap between the panel 1 being pulled out of the stack S and the stack S. Accordingly, if the pushing member 67 contacts one of the panels, operation of the apparatus A is faulty. Actuation of the switch 67 will result in the controller unit 71 producing an alarm signal. Alternatively, the actuation of the switch 67 may result in the controller unit 71 reversing the movement of the pushing member 65.

Displacement of both the pulling device 31 and the pushing device 51 along direction X is advantageously performed by a single actuator member, namely member 11. Two actuator members could be used to perform this task.

The invention claimed is:

1. A method for transferring a panel from a stack of generally upstanding panels supported in a tilted position at an angle from a vertical to a lying position on a receiving surface, said method comprising the steps of:

separating a first panel from a stacked tilted position in the stack of panels by releasably connecting a pulling device to a front exposed face of the first panel and pulling on the first panel with the pulling device so as to cause the first panel to pivot about a bottom edge thereof to an angular clamped position comprised between the stacked tilted position of the first panel and the vertical, thereby creating a gap between the first panel and the stack, the pulling device retaining the first panel against falling back by gravity against the stack;

inserting a pushing device in the gap between the first panel and the stack while the first panel is held in said angular clamped position by the pulling device;

removing the pulling device from the front face of the first panel, the pushing device preventing the first panel from falling back against the stack; and then pushing the first panel with the pushing device from said angular position across the vertical to a free-fall position, the free-fall position being separated from the vertical such that the first panel free-falls under gravity to induce the free fall of the first panel to the lying position.

2. The method according to claim 1, wherein the pulling device releasably connects to the first panel by exerting suction on a surface of the first panel.

3. The method according to claim 1, wherein the first panel in the lying position on the receiving surface is conveyed away, and the steps of the method are repeated to transfer a subsequent panel of the stack of panels to the lying position.

4. An apparatus for transferring panels from a stack of generally upstanding panels supported in a tilted position at an angle from the vertical to a lying position on a receiving surface, the apparatus comprising:

a pulling device having a tool end adapted to be releasably connected to a front surface of a first panel in a stacked tilted position in the stack in a contacting position of the pulling device with the front surface of the panel, the pulling device being actuatable along a first degree of freedom to displace the tool end between the contacting position, and an offset position of the pulling device in which the pulling device is away from a free-fall path of the panels of the stack;

at least one actuator member operatively supporting the pulling device so as to displace the pulling device away from the panel to a transfer position of the pulling device in which the pulling device holds the first panel in an angular position comprised between the original stacked tilted position of the first panel and the vertical, whereby a gap is created between the first panel and the stack, the first panel being prevented from falling back against the stack by said pulling device;

a pushing device having a portion adapted to be inserted in said gap in a pushing position of the pushing device while the first panel is being held in the angular position by the pulling device, the pushing device actuatable in a second degree of freedom independent from the first degree of freedom to displace said portion of the pushing device to the pushing position, the pushing device being operatively supported by said at least one actuator member, whereby the pushing device in the pushing position pushes the first panel away from the angular position thereof, beyond the vertical and to a free-fall position being separated from the vertical by actuation of said at least one actuator member to induce the free fall of the first panel under gravity from the free-fall position to the the lying position; and a controller unit connected to the pulling device, the at least one actuator member and the pushing device, so as to induce the free fall of the panels from the angular position with the pushing device in the pushing position after the pulling device has been moved from the transfer position to a position away from the free fall path.

5. The apparatus according to claim 4, wherein the wherein the tool end of the pulling device has at least one suction cup.

6. The apparatus according to claim 5, wherein the controller unit is connected to a pressure sensor associated with the suction cup so as to determine when the suction cup is releasably connected to the panel, so as to subsequently direct the actuation member in pulling the panel.

7. The apparatus according to claim 4, comprising a single one of the actuator member, with an actuation of the actuator member causing both the pulling and the pushing of the panel with the pulling device and the pushing device respectively.

8. The apparatus according to claim 4, wherein the actuator member is actuatable along one translational degree-of-freedom.

9. The apparatus according to claim 4, wherein both the pulling device and the pushing device have one translational degree-of-freedom.

10. The apparatus according to claim 9, wherein the translational degrees-of-freedom of the pulling device and the pushing device are not parallel to one another.

11. The apparatus according to claim 4, wherein the portion of the pushing device is has a conical-shaped body.

12. The apparatus according to claim 4, further comprising a limit switch on the pulling device, the limit switch being in association with the controller unit and being triggered by contacting the panel, so as to stop the at least one actuator member from displacing the end tool against the panel.

13. The apparatus according to claim 4, further comprising a limit switch on a tip of said portion of the pushing device, the limit switch being in association with the controller unit and being triggered by contacting the panel, so as to stop the actuation of the pushing device toward the pushing position.

14. The apparatus according to claim 8, further comprising a slotted bar and sensor associated with the at least one actuator member with a first one of the slotted bar and sensor being displaceable by actuation of the translational degree-of-freedom while another one of the slotted bar and sensor is fixed, the sensor being connected to the controller unit such that the controller unit calculates as a function of the size of slots in the slotted bar the position of the pulling device with respect to the stack.

* * * * *